US011549364B2

(12) United States Patent
Hagen

(10) Patent No.: US 11,549,364 B2
(45) Date of Patent: Jan. 10, 2023

(54) POSITION SENSING FOR DOWNHOLE ELECTRONICS

(71) Applicant: Halliburton Energy Services, Inc., Houston, TX (US)

(72) Inventor: Trond Hagen, Sandefjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/048,381

(22) PCT Filed: Sep. 4, 2018

(86) PCT No.: PCT/US2018/049332

§ 371 (c)(1),
(2) Date: Oct. 16, 2020

(87) PCT Pub. No.: WO2020/050815

PCT Pub. Date: Mar. 12, 2020

(65) Prior Publication Data

US 2021/0148223 A1 May 20, 2021

(51) Int. Cl.

| | |
|---|---|
| ***E21B 47/13*** | (2012.01) |
| ***E21B 47/09*** | (2012.01) |
| *E21B 47/06* | (2012.01) |

(52) U.S. Cl.
CPC ..... *E21B 47/13* (2020.05); *E21B 47/09* (2013.01); *E21B 47/06* (2013.01)

(58) Field of Classification Search
CPC ..... E21B 47/06; E21B 47/09; E21B 47/13
See application file for complete search history.

(56) References Cited

U.S. PATENT DOCUMENTS 5,784,004 A * 7/1998 Esfahani ..... E21B 47/06 340/854.6
6,070,662 A * 6/2000 Ciglenec ..... E21B 47/13 166/254.1

(Continued)

FOREIGN PATENT DOCUMENTS

| | | |
|---|---|---|
| EP | 2828477 | 1/2015 |
| GB | 2531782 | 5/2016 |

(Continued)

OTHER PUBLICATIONS

GB Application No. GB2016135.2 , "First Examination Report", dated Jun. 23, 2021, 2 pages.

(Continued)

*Primary Examiner* — Christopher J Sebesta
(74) *Attorney, Agent, or Firm* — Kilpatrick Townsend & Stockton LLP

(57) ABSTRACT

Certain aspects of the present disclosure relate to precise position determination for the downhole placement and position of the tubing-side portion of a behind-casing measurement system. The position determination can be used to establish precise alignment of the system and thus prevent signal loss. A system according to some aspects includes a casing-side antenna mountable between a well casing and a formation wall and a processing device connected to the casing-side antenna. The processing device is operable to measure signal intensities for a signal received from at least one tubing-side antenna, calculate a position of the tubing-side antenna relative to the casing-side antenna based on the signal intensities, and transmit the position to the surface.

19 Claims, 8 Drawing Sheets

(56) References Cited

U.S. PATENT DOCUMENTS

| | | | | |
|---|---|---|---|---|
| 6,191,585 | B1 * | 2/2001 | Mercer | G01V 3/15 175/45 |
| 9,359,884 | B2 | 6/2016 | Hallundbaek et al. | |
| 2002/0050930 | A1 * | 5/2002 | Thomeer | E21B 23/02 340/853.3 |
| 2005/0145416 | A1 * | 7/2005 | Reed | E21B 47/26 175/40 |
| 2009/0128141 | A1 | 5/2009 | Hopmann et al. | |
| 2012/0024050 | A1 * | 2/2012 | Godager | E21B 47/10 73/152.05 |
| 2013/0008648 | A1 | 1/2013 | Lovorn et al. | |
| 2014/0076632 | A1 | 3/2014 | Wessling et al. | |
| 2014/0174732 | A1 | 6/2014 | Goodwin et al. | |
| 2014/0214325 | A1 | 7/2014 | Wessling et al. | |
| 2014/0265619 | A1 * | 9/2014 | Chau | E21B 47/09 307/104 |
| 2015/0047839 | A1 | 2/2015 | Godager et al. | |
| 2016/0076363 | A1 | 3/2016 | Morrow et al. | |
| 2016/0258274 | A1 * | 9/2016 | Bittar | E21B 7/04 |
| 2016/0290124 | A1 * | 10/2016 | Chemali | E21B 47/13 |
| 2017/0016317 | A1 * | 1/2017 | Roberson | E21B 47/13 |
| 2017/0298712 | A1 | 10/2017 | Loomans et al. | |
| 2018/0171775 | A1 | 6/2018 | Santos | |
| 2018/0191305 | A1 | 7/2018 | Chien | |

FOREIGN PATENT DOCUMENTS

| | | |
|---|---|---|
| WO | 2014037888 | 3/2014 |
| WO | 2017142505 | 8/2017 |

OTHER PUBLICATIONS

PCT Application No. PCT/US2020/066130 , International Search Report and the Written Opinion, dated Aug. 12, 2021, 10 pages.

International Application No. PCT/US2018/049332, International Search Report and Written Opinion, dated May 29, 2019, 11 pages.

GB. Application No. GB2016135.2 , Office Action, dated Dec. 20, 2021, 4 pages.

* cited by examiner

POSITION SENSING FOR DOWNHOLE ELECTRONICS

TECHNICAL FIELD

The present disclosure relates generally to devices for use in wells. More specifically, but not by way of limitation, this disclosure relates to electronically sensing a relative position for tubing string antennas connected to tubing-string electronics.

BACKGROUND

For penetration-free behind casing measurements, electronic systems sometimes use antennas for power transfer and communication through the casing. The casing is normally fixed to the formation by cementing. Electronics in or on a tubing string can couple to and communicate with electronics outside the casing through the antennas. The electronics outside the casing are part of the casing assembly during run-in-hole ("RIH") and cementing and its position is fixed in the well when cemented. The electronics on the tubing string are moved as RIH operations progress, and can also move unintentionally during measurement operations due to temperature changes, or pressure variations. In order to make behind-casing measurements, alignment between the tubing-side antenna or antennas and the antenna or antennas outside the casing must be maintained. This alignment is typically maintained by trial and error adjustment when an operator notices signal loss or degradation.

DETAILED DESCRIPTION

Certain aspects of the present disclosure relate to precise position determination for the downhole placement and position adjustment of the tubing-side portion of a behind-casing measurement system. For systems using antennas on the tubing side and casing side, the relative position can be electronically determined by evaluating relative signal intensities among antennas, relative signal intensities over time, or both. The position determination can be used to establish precise alignment of the system and thus prevent signal loss or degradation.

A system according to some aspects includes a casing-side antenna or casing-side antennas mountable between a well casing (a "casing string") and a formation wall or additional casing strings, and a processing device connected to the casing-side antenna. The processing device can measure signal intensities for a signal or signals received from a tubing-side antenna, calculate a position of the tubing-side antenna relative to the casing-side antenna based on the signal intensities, and transmit the position to the surface using the communication capabilities of the system. An isolated position transmission can be made, for example during RIH operations, or the position information can be combined with other data, for example during normal operation. The measurements can be accomplished by polling an antenna over time or by taking measurements at multiple antennas.

In some aspects, measurements are accomplished through the use of circuitry including a rectifier and a low-pass filter coupled to each casing-side antenna to produce a voltage indicative of the signal intensity. In some aspects, an analog-to-digital converter (ADC) using multiple channels is used for measuring signal intensity. In some aspects, comparators coupled to a common pulse-width-modulation (PWM) compare signal are used for measuring the signal intensity at each antenna. In some aspects, for example where multiple tubing-side antennas are used, measurements are initially made at casing-side antennas and an offset is added to the measurements at a tubing-side controller prior to transmitting a position up-hole.

Figure 1:
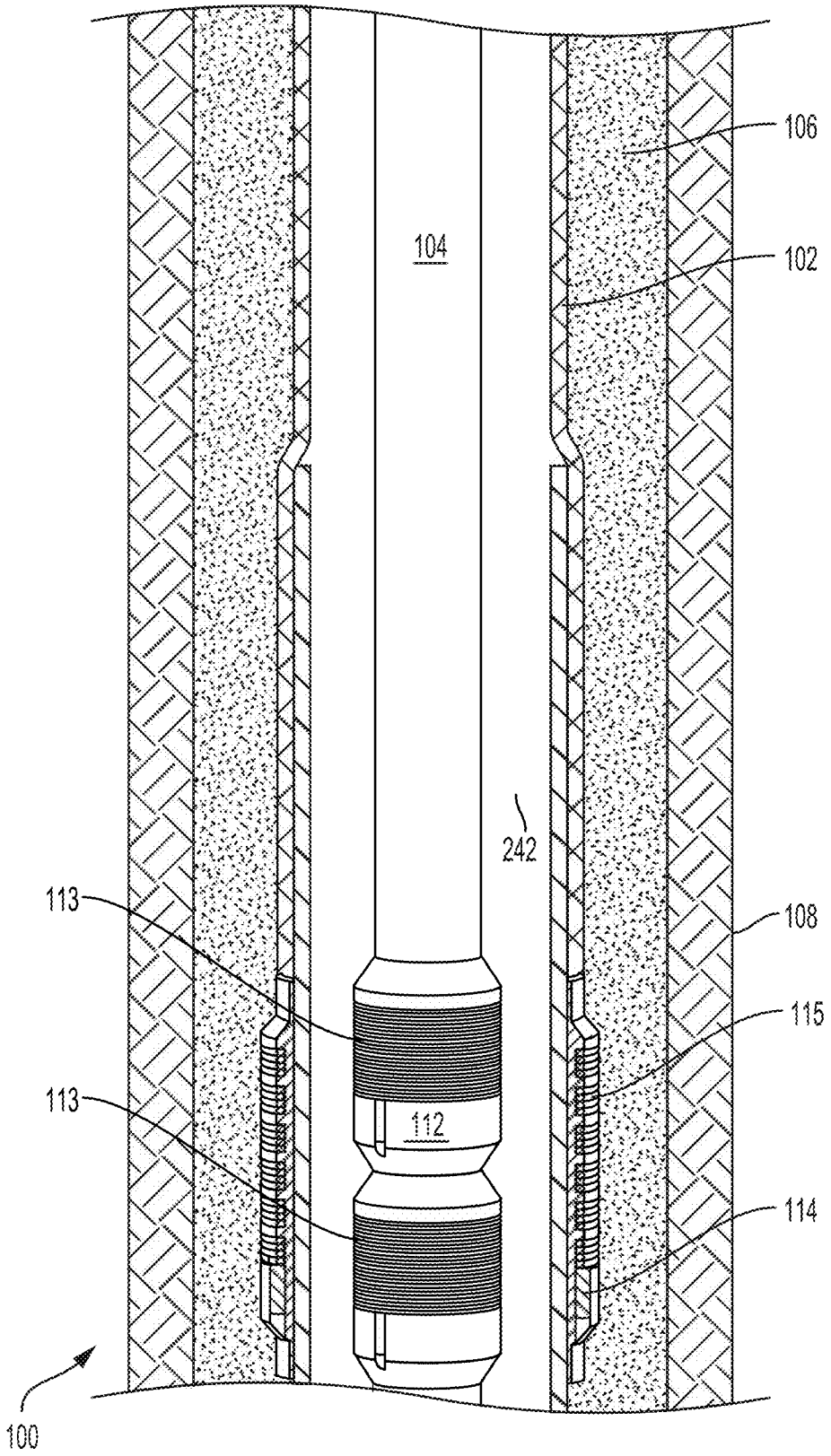
FIG. 1 is a cross-sectional view of a portion of a formation with a well that includes a well casing and a tubing string that includes a system according to some aspects of the present disclosure.

FIG. 1 depicts a portion 100 of a formation with an example well that includes a well casing 102, a tubing string 104 and a behind-casing measurement system according to some aspects. An annulus 242 is formed between well casing 102 and tubing string 104. Casing 102 is cemented in place by cement 106 disposed between well casing 102 and formation wall 108. Tubing-side electronics 112 are communicatively coupled to one or more antennas 113 and is disposed in or on tubing string 104. Throughout this disclosure, the terms coupled or connected can be used to refer to components that are actually coupled or connected together as well as components that are capable of being coupled or connected together but may be separated at times. In some aspects, the antenna or antennas 113 are on the outside of the tubing string 104, located coaxially relative to the outer diameter of the tubing. Behind-casing electronics 114 are connected to one or more antennas 115 that, in operation, couple with antennas 113 in tubing-side electronics 112 to provide measurement data from the formation wall 108. In one or more embodiments, circuitry that implements electronic position detection can be built into casing-side electronics 114. Such an arrangement can assist in position detection as well as fine positioning of tubing-side antennas 113.

Figure 2:
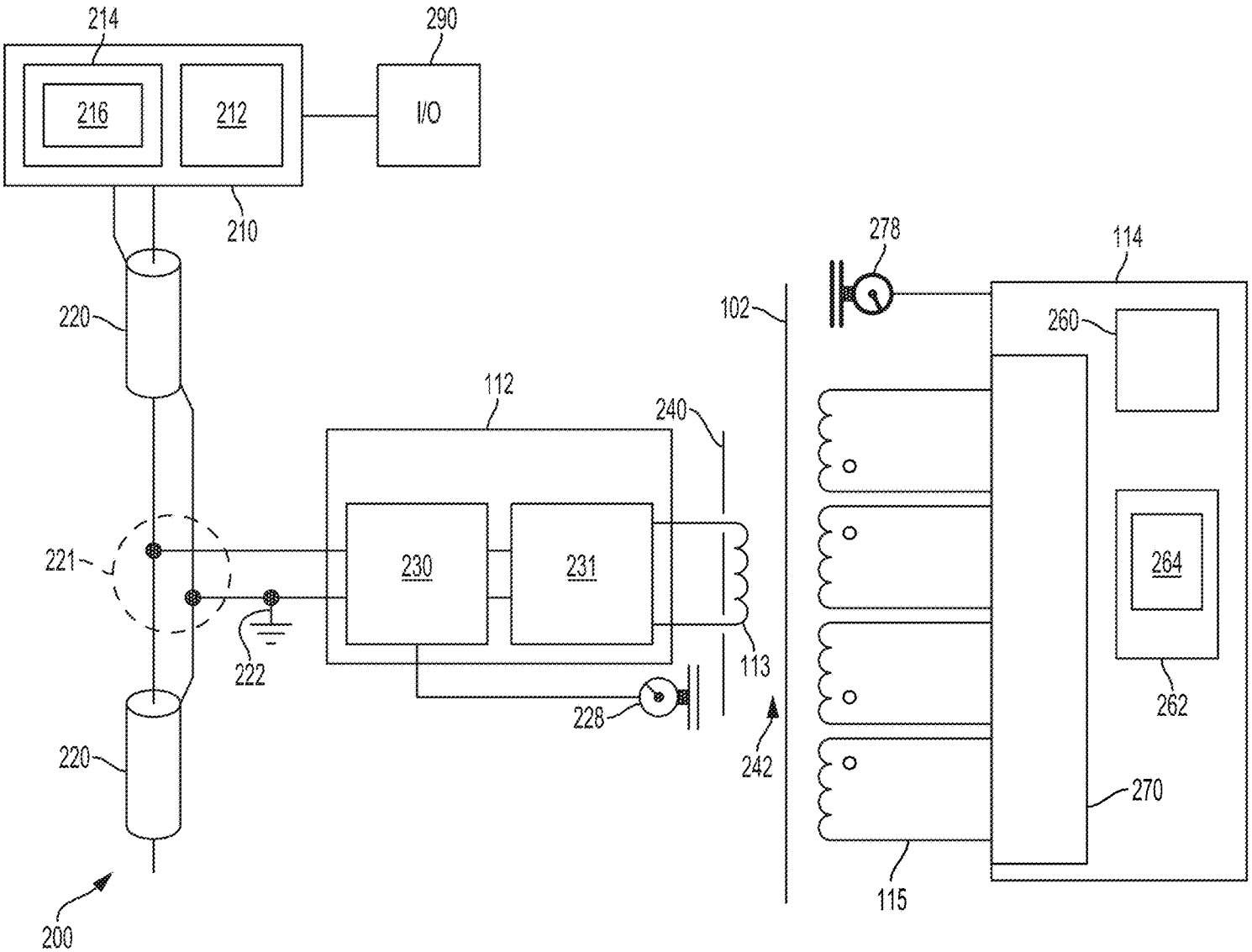
FIG. 2 is a block diagram of a system for down-hole measurements that includes antenna position sensing according to some aspects of the present disclosure.

FIG. 2 is a block diagram of a system 200 for positioning downhole, tubing-side electronics according to some aspects. System 200 of FIG. 2 includes a topside controller 210, which in turn includes a processing device 212 and a non-transitory memory device 214 in which computer program code instructions 216 are stored for causing the processing device to control system 200. The controller 210 is communicatively coupled to tubing-side electronics 112 via transmission line 220 and a y-splitter 221. In one or more embodiments, transmission line 220 can be a tubing encapsulated cable ("TEC") and a local electrical ground 222 may be provided. The TEC cable may also provide power to the tubing-side electronics 112. Tubing-side electronics 112 include interface module 230 with electronics to interface with the transmission line 220, electronics to interface with any sensors that are part of a tubing-side portion of system 200, and electronics to interface with an antenna driver. In this example, tubing-side electronics 112 include sensor 228. Tubing-side electronics 112 also include driver module 231. In this example, interface module 230 and driver module 231 are on tubing 240 of the tubing string 104, which in turn is inside a well casing 102. Tubing 240 can be either magnetic or nonmagnetic. This arrangement creates the annulus 242 between tubing 240 and well casing 102.

Still referring to FIG. 2, antenna 113 is mounted in this example on the outside of tubing 240 in annulus 242. Driver module 231 of system 200 is coupled to antenna 113 and includes the antenna driver, a data transmitter, and a data receiver for the antenna 113. Tubing-side antenna 113 links with behind-casing antennas 115, which are communicatively coupled to casing-side electronics 114. Casing-side electronics 114 include a processing device 260 and a non-transitory memory device 262 in which computer program code instructions 264 are stored for causing the processing device 260 of casing-side electronics 114 to take measurements and communicate information back to tubing-side electronics 112, and in some circumstances to topside controller 210. Casing-side electronics 114 also include interface circuitry 270, which may include any or all of filters, an analog-to-digital converter (ADC), and rectifiers, as will be discussed below. In the example depicted, casing-side electronics 114 include sensor 278.

Continuing with FIG. 2, processing device 260, making use of interface circuitry 270 can measure the signal intensities for a signal received from a tubing-side antenna 113 at the casing-side antennas 115. Processing device 260 can also calculate a position of the tubing-side antenna 113 relative to the casing-side antennas 115 based on the signal intensities, then transmits the position to the surface of the formation using one or more of the casing-side antennas 115 and the tubing-side antenna 113. Because of the multiple antennas 115 coupled to the casing-side electronics 114, processing device 260 can determine the position of the tubing-side antennas (and hence other tubing-side structures such as electronics 112) relative to the casing-side antennas by determining which casing-side antennas are activated at any given time and to what extent the activated antennas are active. Further, processing device 260 can measure the signals coming from all of the antennas. The overall signature given by the antennas can be used for calculating the position of the tubing relative to the casing. Processing device 260 performs the calculations and returns the resulting position value, in this example, with data from the sensor 278 back to the tubing side, and tubing-side electronics 112 transfer the complete data package to the surface controller 210. In one or more embodiments, the tubing-side electronics 112 add data from sensor 228 to the data package prior to the transfer. FIG. 2 shows the use of four casing-side antennas, but a larger number of antennas will result in more accurate measurements. A system like that shown in FIG. 2, in one or more embodiments, can include from four to twenty casing-side antennas. For example, a system with ten antennas may provide a good balance between accuracy, complexity, and cost.

The positioning information can be used when the tubing string 104 is initially placed to precisely align the antennas for communication of casing-side measurements. Alignment should normally be made to the position that allows the greatest margin for movement while maintaining communication. During RIH operations it is usually desirable that the final landing position is located according to plans to make sure there are optimal margins in both directions (longitudinally, up and down) during normal operation. The positioning information allows an operator to see exactly where the tubing string 104 ended up and potentially to fine-tune the placement in the final stage of an RIH operation.

The positioning information can also be used as a diagnostic when signal degradation is detected during normal operation. Fluid flow, temperature changes, and pressure changes can all cause small movements of the tubing string 104 relative to the casing 102. When the tubing-side antennas move outside an allowable alignment range, a warning or alarm can be provided to an operator. Logged data can be used for diagnostics after a system failure, for example, when the communication is lost due to too much longitudinal movement. Temperature and pressure data correlated with exact position can also be logged and this data used for future system dimensioning, possibly allowing for cost savings by building tubing systems of appropriate length for the properties of a well, as opposed to longer than necessary, while minimizing out-of-alignment alarms. Minute movements of the tubing string 104, compensated for pressure and temperature, can also provide a useful indication of flow rate. If the flow effects are significant however, the flow data can also be useful for future system dimensioning purposes. Knowing exactly where the tubing string 104 is relative to the casing 102 at all times during normal operation is also helpful in understanding how well the actual installation went relative to plans and to learn about movement under varying conditions (temperature, pressure, flow).

The processing devices 212 and 260 in FIG. 2 can execute the computer program code instructions stored in the memory devices 214 and 262 to perform the operations of the system. Each processing device can include one processing device or multiple processing devices. Non-limiting examples of the processing devices 212 and 260 include a Field-Programmable Gate Array ("FPGA"), an application-specific integrated circuit ("ASIC"), a microprocessor, etc. The memory device can also be operable to store position values. A device such as an FPGA or ASIC can also be used to implement other modules. Such a device may include computer program code such as computer program code instructions 216 and 264 as part of its "wiring."

The non-volatile memory devices 214 and 262 in FIG. 2 may include any type of memory device that retains stored information when powered off. Non-limiting examples of the memory devices include electrically erasable and programmable read-only memory ("EEPROM"), flash memory, or any other type of non-volatile memory. In some examples, at least some of the memory devices can include a non-transitory medium from which the processing devices 212 and 260 can read instructions. A non-transitory computer-readable medium can include electronic, optical, magnetic, or other storage devices capable of providing the processing devices with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

An operator may provide input to controller 210 of FIG. 2 using an input/output interface 290. An indication that position has been lost, or a position indication of the tubing-side antennas 113 relative to the casing-side antennas 115 can also be provided to an operator through the input/output interface 290. An input/output interface may be located either locally or remotely relative to the rest of the system. Any connections shown between the controller 210 and other instruments or hardware throughout this disclosure can be made wirelessly and can be between components located remotely from each other through a direct or networked connection. Such a networked connection can include the Internet.

Figure 3:
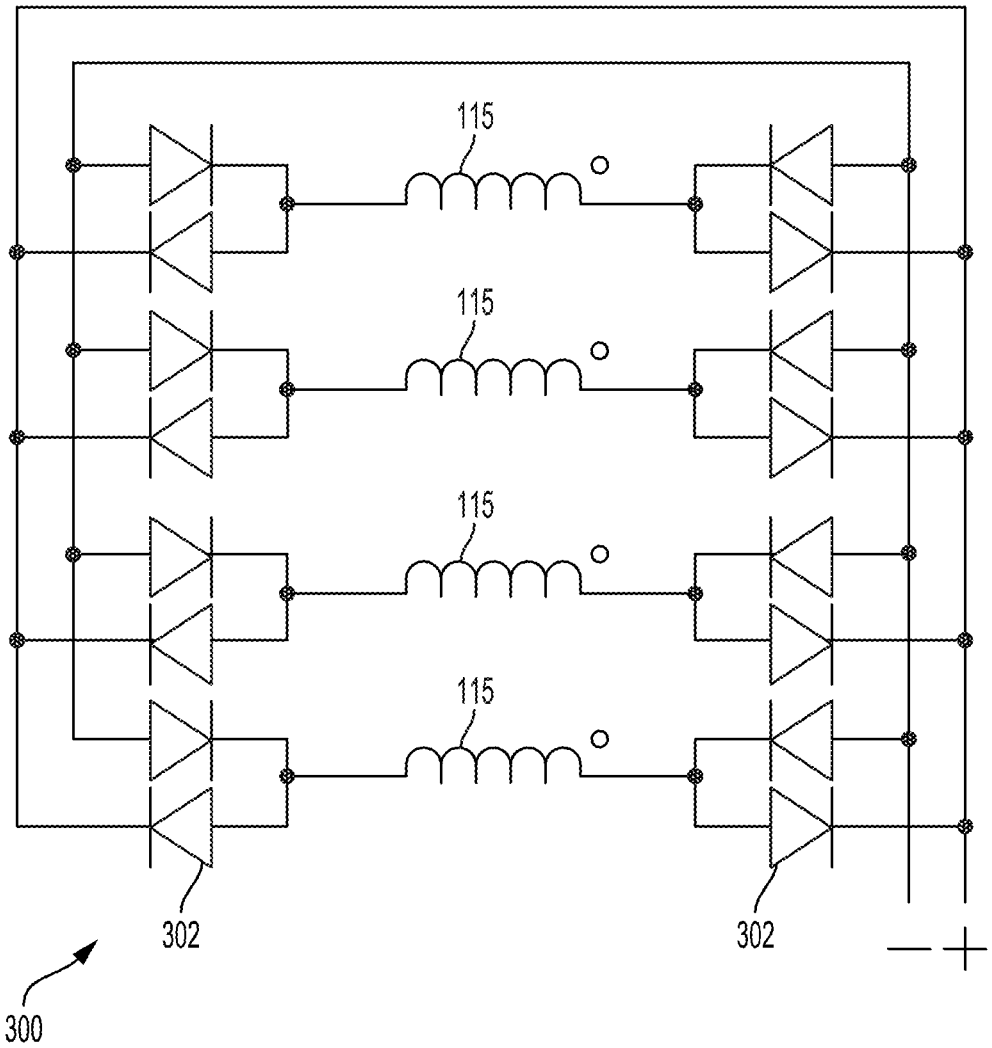
FIG. 3 is a schematic diagram that illustrates a circuit that can be used in a system for down-hole measurements and position sensing according to some aspects of the present disclosure.

FIG. 3 is a schematic diagram that illustrates a circuit 300 that can be used in a system that includes downhole position sensing according to some aspects of the present disclosure. Circuit 300 includes a rectifier arrangement used for connecting several casing-side antennas to one load unit (the sensor and sensor electronics). In the example of FIG. 3, circuit 300 includes four identical diode rectifiers 302, one for each casing-side antenna 115. The diode rectifiers 302 can be included in interface circuitry 270 of system 200 of FIG. 2 and allow measurements to be made with DC signals so that a relatively inexpensive A/D converter can be used. A load can be connected to the '+' and '−' terminals. It should be noted that the diode rectifiers 302 and the interface circuitry 270 generally can be physically located in various places. The diode rectifiers 302 may be part of an antenna assembly.

Figure 4:
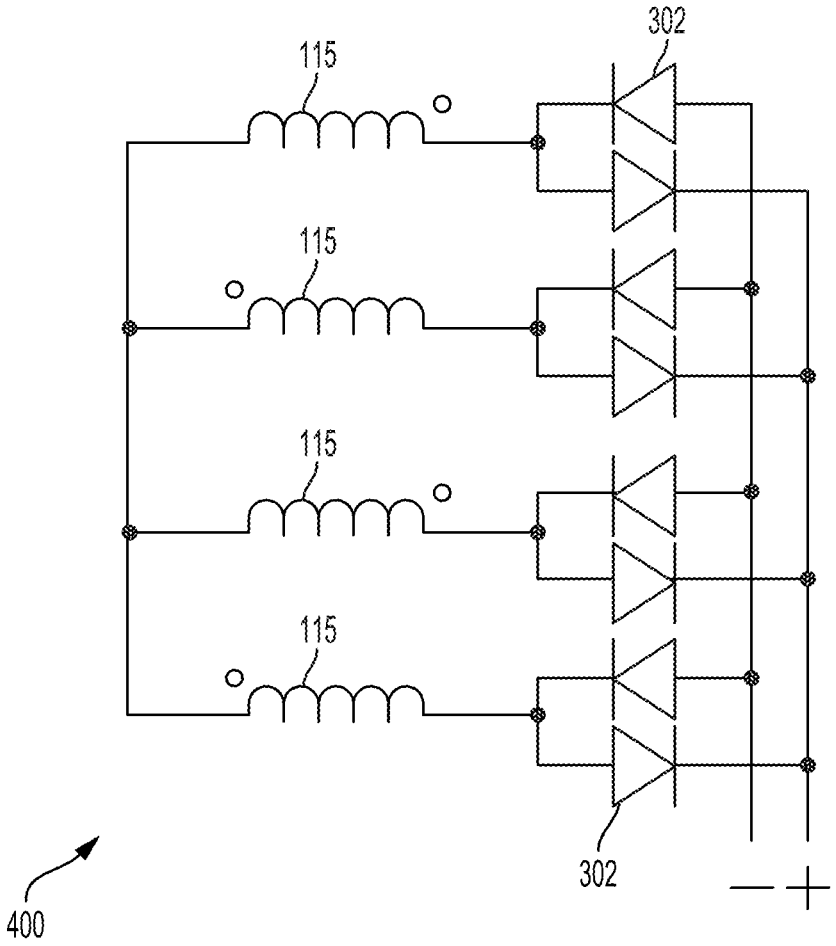
FIG. 4 is a schematic diagram that illustrates a circuit that can be used in a system for down-hole measurements and position sensing according to additional aspects of the present disclosure.

FIG. 4 is a schematic diagram that illustrates a circuit 400 that can alternatively be used in a system including downhole position sensing according to some aspects of the present disclosure. Circuit 400 can provide an alternative way of connecting casing-side antennas to the load. Circuit 400 can be more efficient than circuit 300 discussed above. FIG. 4 depicts an example that includes two identical diode rectifiers 302 for each casing-side antenna 115. As before, the diode rectifiers 302 can be included in interface circuitry 270 of system 200 of FIG. 2 and allow measurements to be made with DC signals so that a relatively inexpensive A/D converter can be used. As before, the diode rectifiers 302 and the interface circuitry 270 generally can be physically located in varying places. The diode rectifiers may be part of an antenna assembly.

Figure 5:
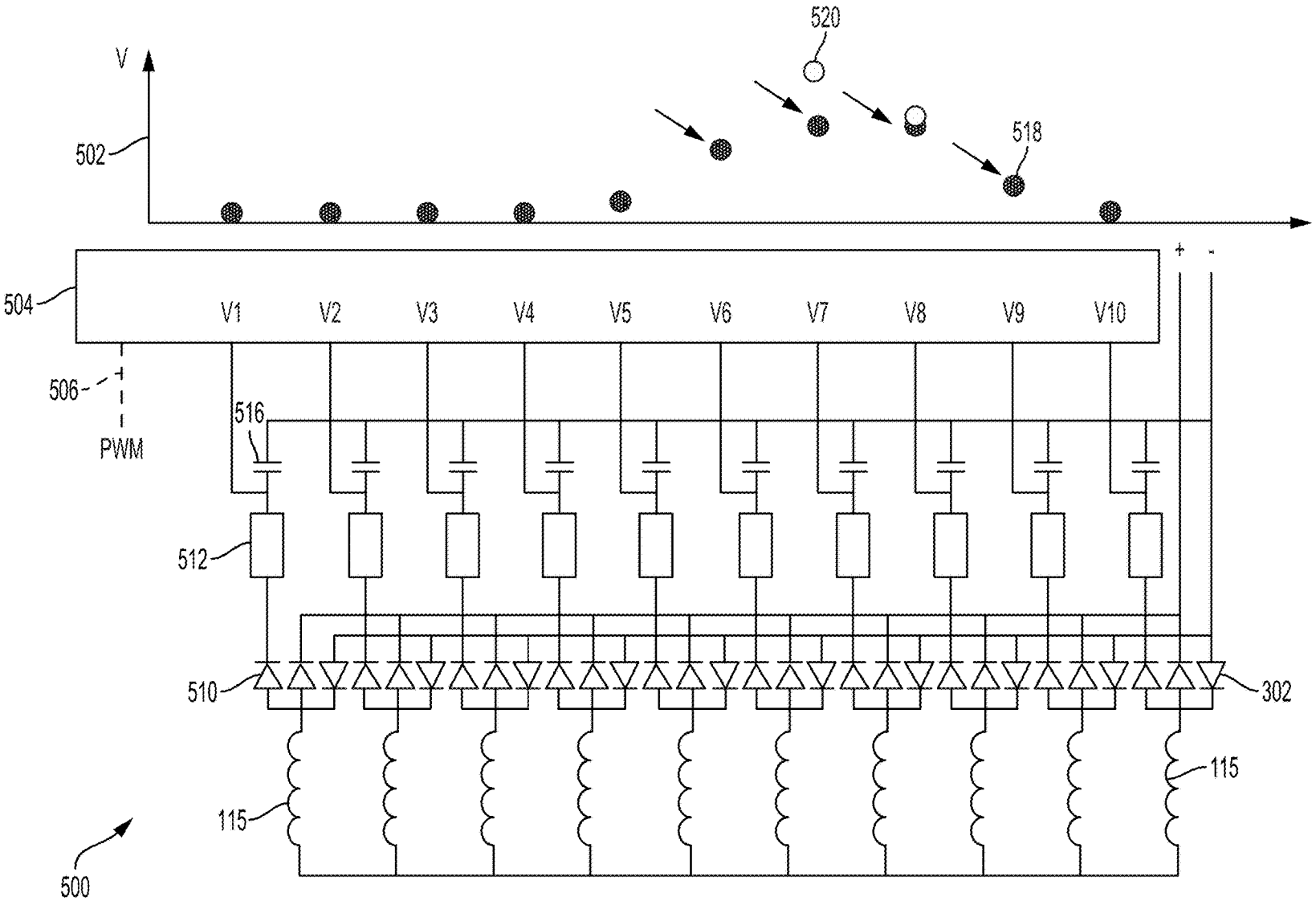
FIG. 5 is a schematic diagram that illustrates a circuit that can be used in a system for down-hole measurements and position sensing as well as the voltage response of the circuit according to some aspects of the present disclosure.

FIG. 5 is a schematic diagram that illustrates a circuit 500 that can be used in a system including downhole position sensing as well as the voltage profile 502 of the circuit 500 according to some aspects of the present disclosure. Circuit 500 includes the circuit configuration from FIG. 4, although the circuit configuration from FIG. 3 could be used with suitable modifications to the other parts of the circuit. Two diodes 302 for each antenna 115 connected to circuit 500 are identical to those used in circuit 400 of FIG. 4. A third diode 510 and RC filter are added to the circuit for each antenna 115 in the purpose of measuring the signal level on each antenna. Circuit 500 of FIG. 5 includes block 504, which in this example is a ten-channel ADC receiving voltages V1-V10 corresponding to signals from ten casing-side antennas.

Circuit 500 of FIG. 5 includes diodes 302 coupled to antennas 115. To avoid analyzing signals with an AC component, another rectifier diode 510 is added to each antenna along with a low pass filter following each diode 510 added to each antenna. The low-pass filter according to one or more embodiments for each antenna includes resistor 512 and capacitor 516, however, other filtering circuits can be used. The voltage profile 502 made up of all the voltage signal levels at any given time indicates where the tubing-side antenna 115 is located. Some calibration of the process executed by the processing device 260 in the casing-side electronics 114 may be required to take into account the fact that the load current will pull down the voltage of antennas being actively loaded. In this example, one, two or three antennas 115 may contribute to the power delivered to a common load and the common load is not evenly distributed. In the case of two or three antennas 115 being loaded, the voltages on loaded antennas will be identical or close to identical. In this case, processing device 260 measures the voltage from antennas adjacent to the two or three loaded antennas.

An alternative approach is to measure the load current for each antenna. If load current is used, a series resistor is coupled to each antenna. Using series resistors causes some power loss and the voltage over each resistor is measured at the positive supply rail ('+') to monitor the current. Sufficient position accuracy can be achieved by determining which antennas are the top three contributors to the total current.

Continuing with FIG. 5, voltage profile 502 illustrates the filtered voltage values generated by circuit 500, where the tubing-side antenna 113 is somewhere between casing-side antennas six and seven. The dark sample points 518 are actual voltages when a load pulls down the voltage for antennas seven and eight to the same level, slightly below that of unloaded antenna eight in this example. The open sample points 520 are the voltage values as they would have been with no load. The four values with arrows are used to determine where the tubing-side antenna is located.

Optionally, block 504 of FIG. 5 can, instead of an ADC, include a plurality of comparators coupled to a common pulse-width-modulation (PWM) compare signal 506 for measuring the signal intensity at each of the plurality of casing-side antennas 115. A voltage indication is given by the PWM duty cycle at the trigger time or as a time value indirectly indicating the voltage. Another alternative to the circuit of FIG. 5 is to use digital inputs of gate devices as comparators, relying on low-to-high thresholds of the digital inputs. Although exact voltage values cannot be obtained with such an arrangement, alignment can still be accomplished using the threshold relationships between antennas. A circuit to implement this alternative can be built as a custom ASIC without external diodes and filters. Such an implementation would limit the number of components required, reducing cost and improving reliability while sacrificing some precision and versatility.

Figure 6:
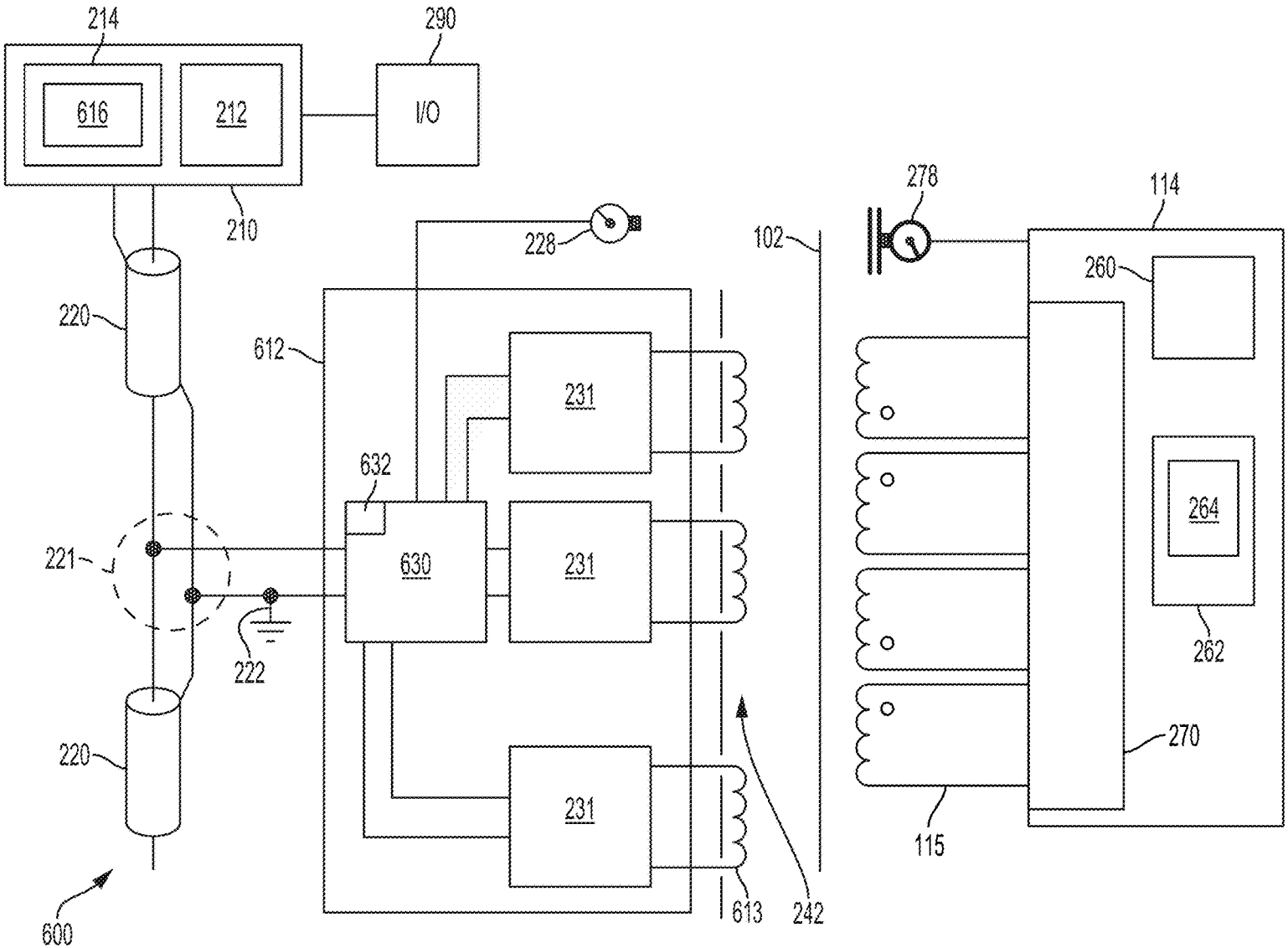
FIG. 6 is a block diagram of a system for down-hole measurements that includes antenna position sensing according to further aspects of the present disclosure.

FIG. 6 is a block diagram of a system 600 for positioning downhole, tubing-side antennas according to some aspects. System 600 is similar to system 200 of FIG. 2 in many respects. System 600 of FIG. 6, however includes multiple antennas 613 on the tubing string and multiple driver modules 231 as part of the tubing-side electronics 612. Although FIG. 6 shows the use of three tubing-side antennas, a larger number of antennas will likely result in more accurate measurements, similar to the situation with the casing-side antennas 115 described in FIG. 2. As such, a system like that shown in FIG. 6, in one or more embodiments, can include from three to twenty tubing-side antennas. For example, a system with five to fifteen antennas may provide a good balance between accuracy, complexity, and cost.

System 600 of FIG. 6 includes the topside controller 210, which in turn includes a processing device 212 and a non-transitory memory device 214, in this case with computer program code instructions 616 for causing the processing device to control system 600 to carry out communications using multiple tubing-side antennas 613. The tubing-side electronics 612 of system 600 include interface module 630 with electronics to interface with the transmission line 220, electronics to interface with sensor 228, and electronics to interface with multiple driver modules 331.

Still referring to FIG. 6, casing-side electronics 114 again include a processing device 260 and a non-transitory memory device 262 in which computer program code instructions 264 are stored for causing the processing device to control casing-side electronics 114 to take measurements and communicate information back to tubing-side electronics 612 and possibly to topside controller 210. Casing-side electronics 114 also include interface circuitry 270 and sensor 278. System 600 of FIG. 6 operates slightly differently than system 200 of FIG. 2 in that an offset value must be selectively added to the position value reported from the casing-side electronics. In this example, the offset is added, when needed, by computer program code instructions 632 within interface module 630. This offset could instead be added by computer program code instructions 616 in topside controller 210. The offset may be needed based on which of antennas 613 was active at the time of signal intensity measurement as indicated by a time stamp of the position value sent by casing-side electronics 114.

Figure 7:
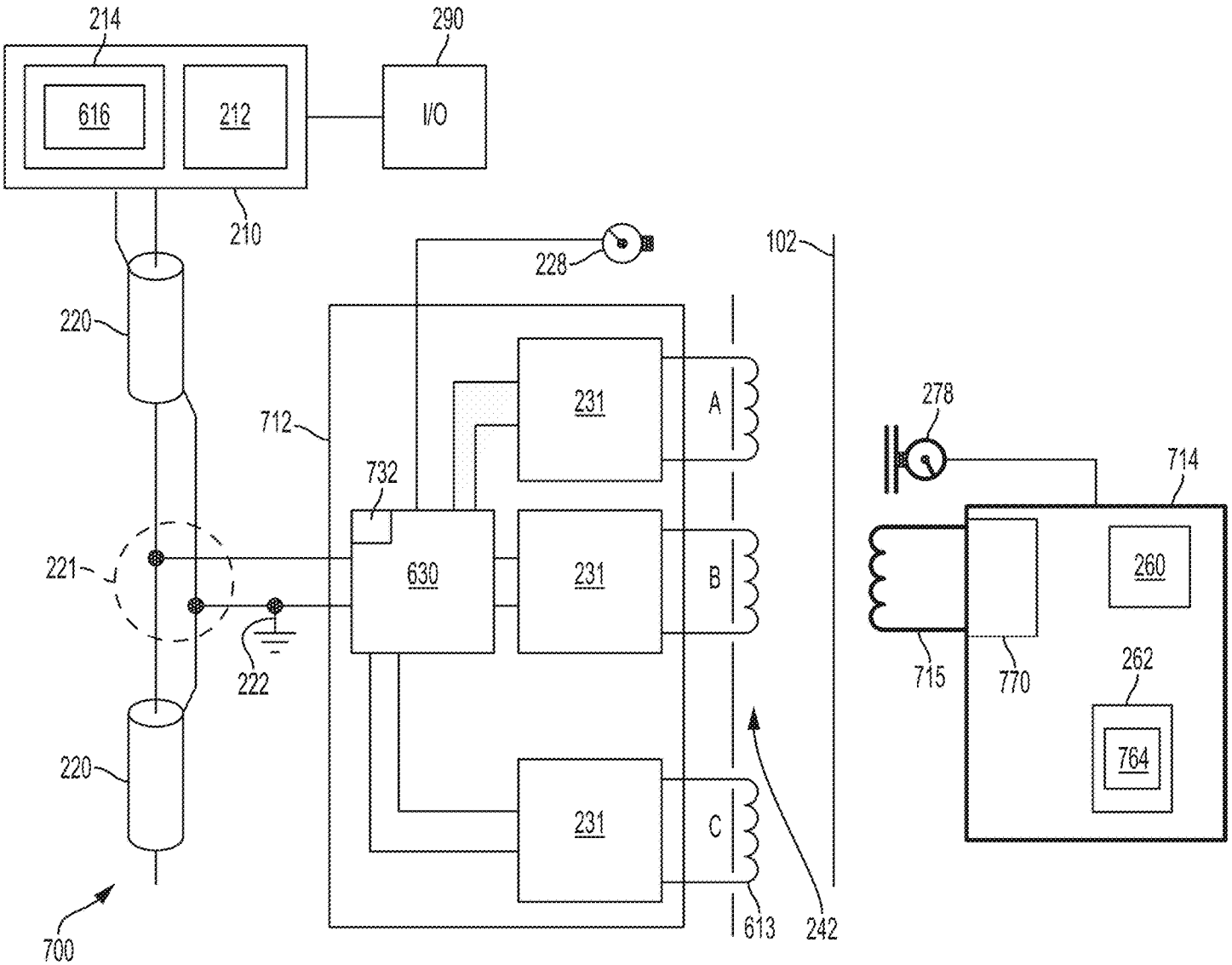
FIG. 7 is a block diagram of a system for down-hole measurements that includes antenna position sensing according to additional aspects of the present disclosure.

FIG. 7 is a block diagram of a system for down-hole antenna position sensing according to additional aspects of the present disclosure. System 700 is similar to system 600 of FIG. 6 in many respects. System 700 of FIG. 7 includes multiple antennas 613 on the tubing string 102 and multiple driver modules 231 as part of the tubing-side electronics 712. System 700 of FIG. 7 includes the topside controller 210, which in turn includes a processing device 212 and a non-transitory memory device 214, in this case with computer program code instructions 716 for causing the processing device to control system 700 to carry out communications using multiple antennas 613. The tubing-side electronics 712 of system 700 include interface module 630 with electronics to interface multiple driver modules 331 and computer program code instructions 732 for providing some of the positioning determination function.

With system 700, since there is no casing-side stack, there is no rectifier arrangement as shown in FIG. 5. With just one casing-side antenna 715, only one point on the amplitude curve can be discerned at any single point in time. However, in this case, the position can be determined by "seeing" which of the tubing-side antennas is within reach of the single casing-side antenna 715. In some positions, contact with two (or even three) tubing-side antennas 613 occurs. In such a case, accuracy of the position determination can be increased by looking at the one, two, or three amplitude levels using the one, two or three tubing-side antennas 613 rather than by time multiplexing tubing-side antennas to obtain the amplitude measurements.

Still referring to FIG. 7, casing-side electronics 714 in this example include a processing device 260 and a non-transitory memory device 262 in which computer program code instructions 764 are stored for causing the processing device to control casing-side electronics 714 to take measurements and communicate information back to tubing-side electronics 712 and possibly to topside controller 210. Casing-side electronics 714 also include interface circuitry 770 and sensor 278. System 700 of FIG. 7 measures signal intensities by polling the single casing-side antenna 715 over time to track the activity of tubing-side antennas 613. An initial polling can provide a rough position estimate by seeing which one of the antennas 613 was activated to make contact with the casing-side antenna 715. Computer program code instructions 764 in the casing-side electronics 714 and computer program code instructions 732 in the tubing-side electronics 712 control the process. Computer program code instructions 716 may also provide some of the function. Tubing-side antennas 613 adjacent to the antenna used for contacting the casing side can be activated either sequentially or simultaneously.

As an alternative to using a correction factor with a single casing-side antenna as shown in FIG. 7, varying signal levels among tubing-side antennas 613 can be used as follows. For example, as shown in FIG. 7, three tubing-side antennas 613 can be used. For purposes of this example, these three antennas 613 can be designated A, B, and C going from top to bottom. Then, if only middle antenna B is capable of powering the casing-side electronics 714 to get a reading back from the casing side, it is known that the casing-side antenna 715 is closer to middle antenna B on the tubing side than to any of the other tubing-side antennas 613. If the power level of the signal feeding this middle antenna B can be set, for example, by reducing the power to middle antenna B to 50%, it can be determined what power level is needed at other antennas 613 for powering the casing-side electronics 714. For example, if it can be determined that the system needs to power top antenna A to 60% or bottom antenna C to 80% at the same time that middle antenna B is powered at 50% to power the casing-side electronics 714, it can be assumed that the casing-side antenna 715 is a certain distance closer to bottom antenna C than it is to top antenna A. Several such iterations can be executed to provide the necessary position accuracy.

Another alternative to using a correction factor in the scenario above when each of the tubing-side antennas 613 is capable of powering the casing side electronics 714 alone is to power antennas A, B and C sequentially at 100% and monitor the voltage reading from the casing-side antenna 715. If one assumes, as an example, that top antenna A gives a 7V reading, middle antenna B gives 12V reading, and bottom antenna C gives a 5V reading, then the position of the casing-side antenna 715 is closest to middle antenna B and more in the direction of top antenna A than bottom antenna C since top antenna A produces a higher voltage than bottom antenna C. Again, such a technique can be iteratively repeated to provide the necessary accuracy.

The systems of FIG. 2, FIG. 6, and FIG. 7 can be implemented in varying ways. Interface modules 230 and 630 can include an ASIC, an FPGA, or a microcontroller as the processing device. Firmware to implement aspects of this disclosure on system 200, system 600, or system 700 can be stored in memory that is part of a microcontroller or in a separate memory device that is part of an interface module. The frequency of operation of the system can be varied. The type of antenna used will depend on the chosen frequency of operation.

Figure 8:
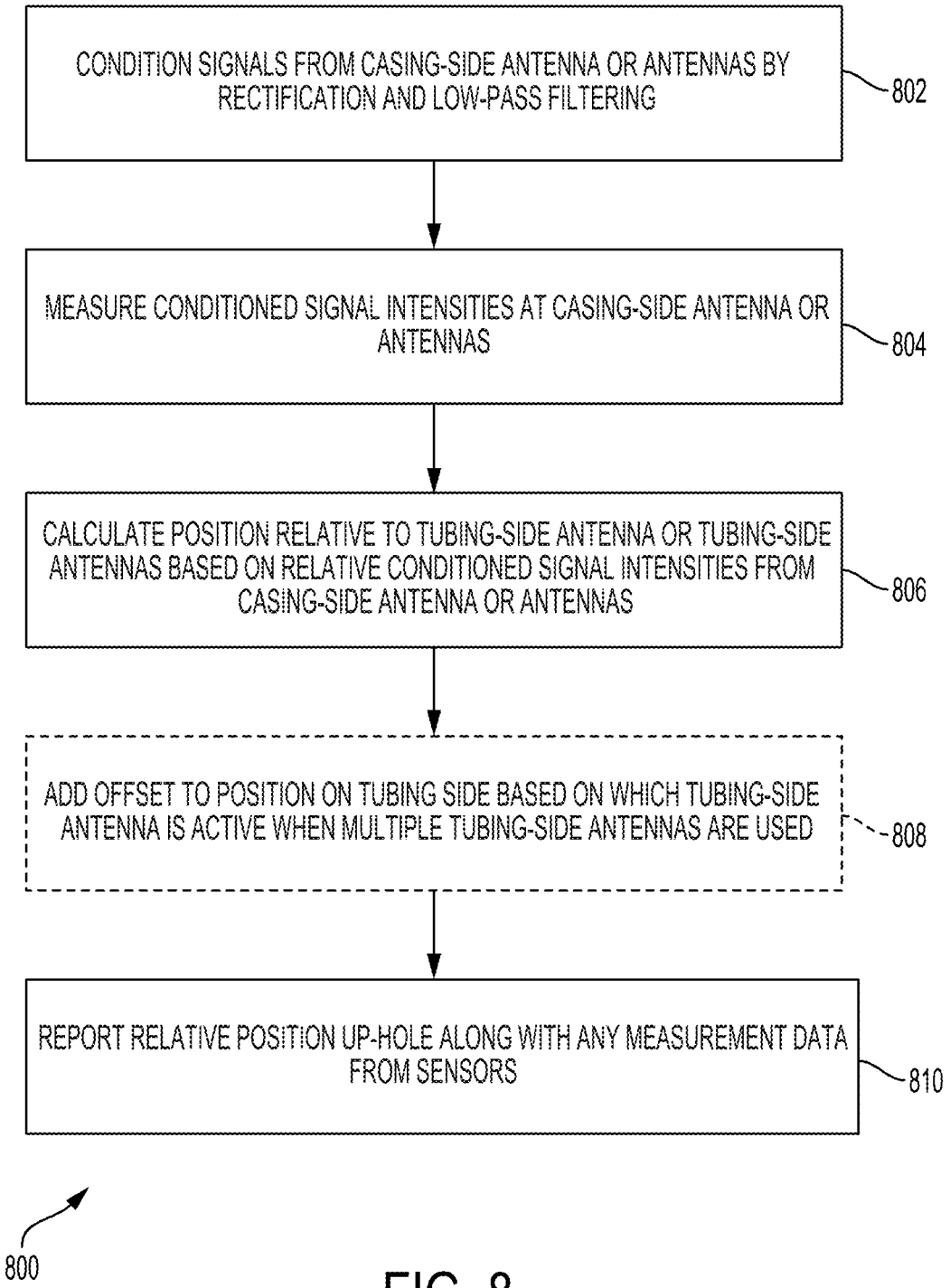
FIG. 8 is a flowchart illustrating a method of down-hole antenna position sensing according to some aspects of the present disclosure.

FIG. 8 is a flowchart illustrating a method 800 of down-hole antenna position sensing according to some aspects of the present disclosure. At block 802, signals from the casing-side antenna or casing-side antennas, 115 or 715 are conditioned by rectification and low-pass filtering using, as an example, interface circuitry 270. At block 804, the conditioned signal intensities for a signal or signals received from a tubing-side antenna or tubing-side antennas 113 or 613 at the casing-side antenna or casing-side antennas 115 or 715 are measured by processing device 260. As discussed above, signal intensities can be determined by polling a casing-side antenna over time or by using multiple casing-side antennas. At block 806, the processing device 260 in the casing-side electronics 114 or 714 calculates a position of the tubing-side antenna or antennas 113 or 613 relative to the casing-side antenna or antennas 115 or 715 based on the signal intensities. At block 808, an offset is optionally added to the position determination to account for multiple tubing-side antennas. This offset can be added by the tubing-side hardware and software such as interface module 630 or by topside controller 210. At block 810, a relative position is reported uphole to the surface using at least one casing-side antenna 115 or 715 and at least one tubing-side antenna 113 or 613. The position can be sent from the casing-side antenna or antennas to a tubing-side antenna for forwarding uphole, either with or without the offset being added by tubing-side electronics 112, 612, or 712, or processing device 212 in the topside controller 210.

Unless specifically stated otherwise, it is appreciated that throughout this specification that terms such as "processing," "calculating," "determining," "operations," or the like refer to actions or processes of a computing device, such as the controller or processing device described herein, that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "coupled," "couplable," "connected" or "connectable" can be connected directly or through intervening elements.

In some aspects, a system and method for electronic position sensing is provided according to one or more of the following examples. As used below, any reference to a series of examples is to be understood as a reference to each of those examples disjunctively (e.g., "Examples 1-4" is to be understood as "Examples 1, 2, 3, or 4").

Example 1. An apparatus includes a casing-side antenna mountable between a well casing and a formation, and a processing device connected to the casing-side antenna. The processing device is operable to measure signal intensities for a signal received from a tubing-side antenna at the casing-side antenna, calculate a position of the tubing-side antenna relative to the casing-side antenna based on the signal intensities, and transmit the position to a surface of the formation.

Example 2. The apparatus of example 1, wherein the signal intensities are measurable by polling the casing-side antenna.

Example 3. The apparatus of example(s) 1-2, wherein the casing-side antenna includes multiple casing-side antennas and wherein each signal intensity of the signal intensities corresponds to one casing-side antenna of the multiple casing-side antennas.

Example 4. The apparatus of example(s) 1-3 further includes rectifiers coupled to each of the casing-side antennas to produce a voltage indicative of each signal intensity of the multiple signal intensities.

Example 5. The apparatus of example(s) 1-4 further includes resistors coupled to each casing-side antenna to monitor load currents indicative of the signal intensities.

Example 6. The apparatus of example(s) 1-5 includes the tubing-side antenna, a driver module coupled to the tubing-side antenna, and a transmission line coupled between the driver module and the surface.

Example 7. The apparatus of example(s) 1-6, wherein the tubing-side antenna further includes multiple tubing-side antennas, and the apparatus further includes a controller communicatively coupled to the driver module, wherein the controller is operable to add an offset value to the position based on which tubing-side antenna is active.

Example 8. A method of sensing a relative position of down-hole a tubing-side antenna includes measuring signal intensities for a signal received from the tubing-side antenna at a casing-side antenna, calculating a position of the tubing-side antenna relative to the casing-side antenna based on the signal intensities, and transmitting the position to a surface of a formation.

Example 9. The method of example 8 wherein each signal intensity is measured by polling the casing-side antenna over time.

Example 10. The method of example(s) 8-9 wherein the casing-side antenna includes multiple casing-side antennas and wherein each signal intensity corresponds to one casing-side antenna.

Example 11. The method of example(s) 8-10 wherein each signal intensity is measured by determining a voltage at each casing-side antenna.

Example 12. The method of example(s) 8-11 wherein each signal intensity is measured by determining a load current at each casing-side antenna.

Example 13. The method of example(s) 8-12 wherein the tubing-side antenna includes multiple tubing-side antennas, and the method further includes adding an offset value to the position based on which tubing-side antenna is active.

Example 14. A system for sensing a relative position of a down-hole, tubing-side antenna includes multiple casing-side antennas mountable between a well casing and a formation, at least one tubing-side antenna mountable in or on a tubing string, a driver module connected to the tubing-side antenna, a transmission line connected between the driver module and the surface, and a processing device connected to the casing side antennas. The processing device is operable to measure a signal intensity for a signal received from the at least one tubing-side antenna at each of the casing-side antennas, calculate a position of the at least one tubing-side antenna relative to the casing-side antennas based on the signal intensity, and transmit the position to a surface of the formation through the transmission line using at least one of the casing-side antennas, the tubing-side antenna, and the driver module.

Example 15. The system of example 14 includes a rectifier coupled to each casing-side antenna to produce a voltage indicative of the signal intensity.

Example 16. The system of example(s) 14-15 includes a low-pass filter coupled to the rectifier.

Example 17. The system of example(s) 14-16 includes an analog-to-digital converter (ADC) coupled to the low-pass filter.

Example 18. The system of example(s) 14-17 includes multiple comparators coupled to a common pulse-width-modulation (PWM) compare signal for measuring the signal intensity at each casing-side antenna.

Example 19. The system of example(s) 14-18 includes resistor coupled to each casing-side antenna to monitor a load current indicative of the signal intensity, wherein the signal intensity is measurable by determining the load current.

Example 20. The system of example(s) 14-19 wherein the at least one tubing-side antenna includes multiple tubing-side antennas, and wherein the system further includes a controller communicatively coupled to the driver module to add an offset to the position based on which tubing-side antenna of the multiple tubing-side antennas is active.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. An apparatus comprising:

a casing-side antenna mountable between a well casing and a formation; and a processing device connected to the casing-side antenna, the processing device operable to:

measure a plurality of signal intensities by polling a plurality of casing-side antennas that includes the casing-side antenna to identify a tubing-side antenna that activated to make contact with the casing-side antenna, the plurality of signal intensities including an amplitude for a signal received from the tubing-side antenna at the casing-side antenna;

using a signal of the plurality of signal intensities that is at a level for powering electronics associated with the casing-side antenna to calculate a position of the tubing-side antenna relative to the casing-side antenna; and transmit the position to a surface of the formation.

2. The apparatus of claim 1, wherein each signal intensity of the plurality of signal intensities corresponds to one casing-side antenna of the plurality of casing-side antennas.

3. The apparatus of claim 2, further comprising a plurality of rectifiers coupled to each of the plurality of casing-side antennas to produce a voltage indicative of each signal intensity of the plurality of signal intensities.

4. The apparatus of claim 1, further comprising a plurality of resistors coupled to each casing-side antenna of the plurality of casing-side antennas to monitor load currents indicative of the plurality of signal intensities.

5. The apparatus of claim 1, further comprising:

the tubing-side antenna;

a driver module coupled to the tubing-side antenna; and a transmission line coupled between the driver module and the surface.

6. The apparatus of claim 5, wherein the tubing-side antenna further comprises a plurality of tubing-side antennas, the apparatus further comprising a controller communicatively coupled to the driver module, wherein the controller is operable to add an offset value to the position based on which tubing-side antenna of the plurality of tubing-side antennas is active.

7. The apparatus of claim 1, wherein the tubing-side antenna is positioned on an outside of a tubing string and coaxially with an outer diameter of the tubing string, and wherein the casing-side antenna is positioned on an outside of the well casing.

8. A method comprising:

measuring a plurality of signal intensities by polling a plurality of casing-side antennas to identify a tubing-side antenna that activated to make contact with a casing-side antenna of the plurality of casing-side antennas, the plurality of signal intensities including an amplitude for a signal received from the tubing-side antenna at the casing-side antenna;

using a signal of the plurality of signal intensities that is at a level for powering electronics associated with the casing-side antenna to calculate a position of the tubing-side antenna relative to the casing-side antenna; and transmitting the position to a surface of a formation.

9. The method of claim 8 wherein each signal intensity of the plurality of signal intensities corresponds to one casing-side antenna of the plurality of casing-side antennas.

10. The method of claim 9 wherein each signal intensity of the plurality of signal intensities is measured by determining a voltage at each casing-side antenna of the plurality of casing-side antennas.

11. The method of claim 9 wherein each signal intensity of the plurality of signal intensities is measured by determining a load current at each casing-side antenna of the plurality of casing-side antennas.

12. The method of claim 8 wherein the tubing-side antenna comprises a plurality of tubing-side antennas, the method further comprising adding an offset value to the position based on which tubing-side antenna of the plurality of tubing-side antennas is active.

13. A system for sensing a relative position of a downhole, tubing-side antenna, the system comprising:

a plurality of casing-side antennas mountable between a well casing and a formation;

at least one tubing-side antenna mountable in or on a tubing string;

a driver module connected to the tubing-side antenna;

a transmission line connected between the driver module and a surface of the formation; and a processing device connected to the plurality of casing-side antennas, the processing device operable to:

measure, by polling the plurality of casing-side antennas to identify the at least one tubing-side antenna, a signal intensity that includes an amplitude for a signal received from the at least one tubing-side antenna at each of the plurality of casing-side antennas, the signal intensity being a maximum signal intensity of a plurality of signal intensities;

use a signal of the plurality of signal intensities that is at a level for powering electronics associated with the casing-side antenna to calculate a position of the at least one tubing-side antenna relative to the plurality of casing-side antennas; and transmit the position to a surface of the formation through the transmission line using at least one of the plurality of casing-side antennas, the at least one tubing-side antenna and the driver module.

14. The system of claim 13 comprising a rectifier coupled to each casing-side antenna of the plurality of casing-side antennas to produce a voltage indicative of the signal intensity.

15. The system of claim 14 further comprising a low-pass filter coupled to the rectifier.

16. The system of claim 15 further comprising an analog-to-digital converter (ADC) coupled to the low-pass filter.

17. The system of claim 15 further comprising a plurality of comparators coupled to a common pulse-width-modulation (PWM) compare signal for measuring the signal intensity at each casing-side antenna of the plurality of casing-side antennas.

18. The system of claim 13 further comprising a resistor coupled to each casing-side antenna of the plurality of casing-side antennas to monitor a load current indicative of the signal intensity, and wherein the signal intensity is measurable by determining the load current.

19. The system of claim 13 wherein the at least one tubing-side antenna comprises a plurality of tubing-side antennas, and further comprising a controller communicatively coupled to the driver module to add an offset to the position based on which tubing-side antenna of the plurality of tubing-side antennas is active.

* * * * *